United States Patent [19]

Glanvall et al.

[11] 3,981,703

[45] Sept. 21, 1976

[54] MULTISTAGE VANE TYPE ROTARY COMPRESSOR

[75] Inventors: Rune Valdemar Glanvall; Anders Lundberg, both of Norrkoping, Sweden

[73] Assignee: Stal-Refrigeration AB, Norrkoping, Sweden

[22] Filed: Apr. 15, 1975

[21] Appl. No.: 568,209

[30] Foreign Application Priority Data

Apr. 23, 1974 Sweden ..... 7405408

[52] U.S. Cl. ..... 62/509; 62/510; 417/204

[51] Int. Cl.[2] ..... F25B 1/10; F04B 23/10

[58] Field of Search ..... 417/204, 206; 418/13; 62/509, 510

[56] References Cited

UNITED STATES PATENTS

| | | | |
|---|---|---|---|
| 2,255,782 | 9/1941 | Kendrick | 417/204 |
| 2,272,093 | 2/1942 | McCormack | 62/510 |
| 2,294,352 | 8/1942 | White | 417/204 |
| 3,079,864 | 5/1963 | Drutchas et al. | 417/204 |
| 3,081,706 | 3/1963 | Drutchas et al. | 417/204 |
| 3,381,891 | 5/1968 | Bellmer | 418/13 |
| 3,489,092 | 1/1970 | Thomson | 417/206 |
| 3,568,466 | 3/1971 | Brandin et al. | 62/510 |
| 3,680,980 | 8/1972 | Bart | 418/13 |
| 3,782,867 | 1/1974 | Gerlach et al. | 418/221 |

FOREIGN PATENTS OR APPLICATIONS

| | | | |
|---|---|---|---|
| 1,003,995 | 11/1951 | France | 62/510 |
| 157,423 | 12/1932 | Switzerland | 62/510 |

*Primary Examiner*—John J. Vrablik
*Attorney, Agent, or Firm*—Cyrus S. Hapgood

[57] ABSTRACT

A rotary vane compressor wherein the vane slots are used as compression chambers in a supplemental compression stage.

1 Claim, 4 Drawing Figures

MULTISTAGE VANE TYPE ROTARY COMPRESSOR

The present invention relates to a vane type rotary compressor.

Often within the gas compression field, it is necessary to compress a gas in a plurality of separate stages. This is the case, for example, when a gas is to be compressed to an intermediate pressure, then treated in some way (for instance cooled) and then compressed to a final pressure.

One variety of compressor, the vane type compressor, is especially suitable for use in certain applications such as refrigeration systems. The present invention concerns a way of readily adapting the vane type compressor to multistage operation.

The present invention allows an extra stage of compression to be obtained from a vane type compressor without alteration of its principal structure by utilizing the change in volume of the vane slots behind the vanes to produce useful work. Such utilization has the additional advantage that the gas pressure behind the vanes continually forces them outward against the inner circumferential wall of the stator, thereby minimizing the phenomenon of vane jumping and promoting good sealing action.

In multistage compressors, it has been found generally desireable that stages operating with higher inlet pressures have work chambers with smaller stroke volumes then stages operating with lower inlet pressures. The present invention conforms to this criterion, since the vane slots, having relatively small stroke volume, operate with higher inlet pressure than the normal working chambers.

Figure 1:
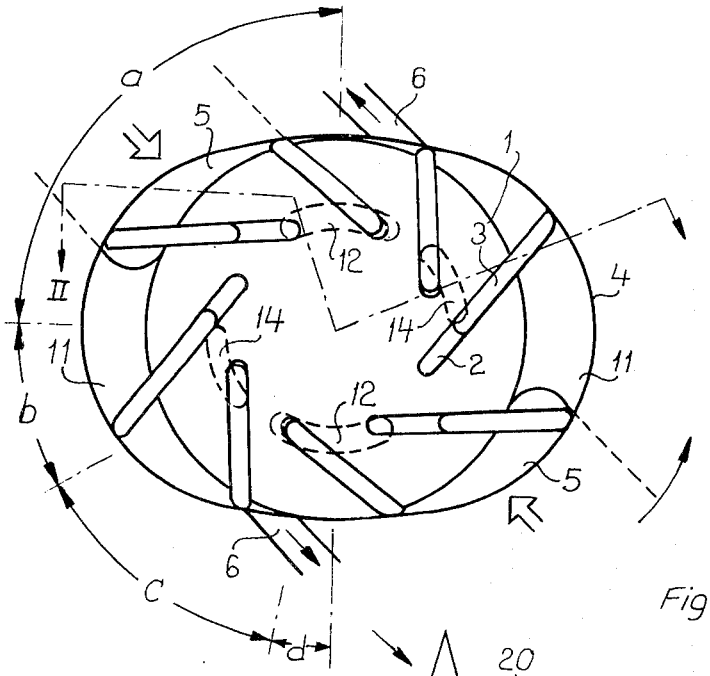
Figure 2:
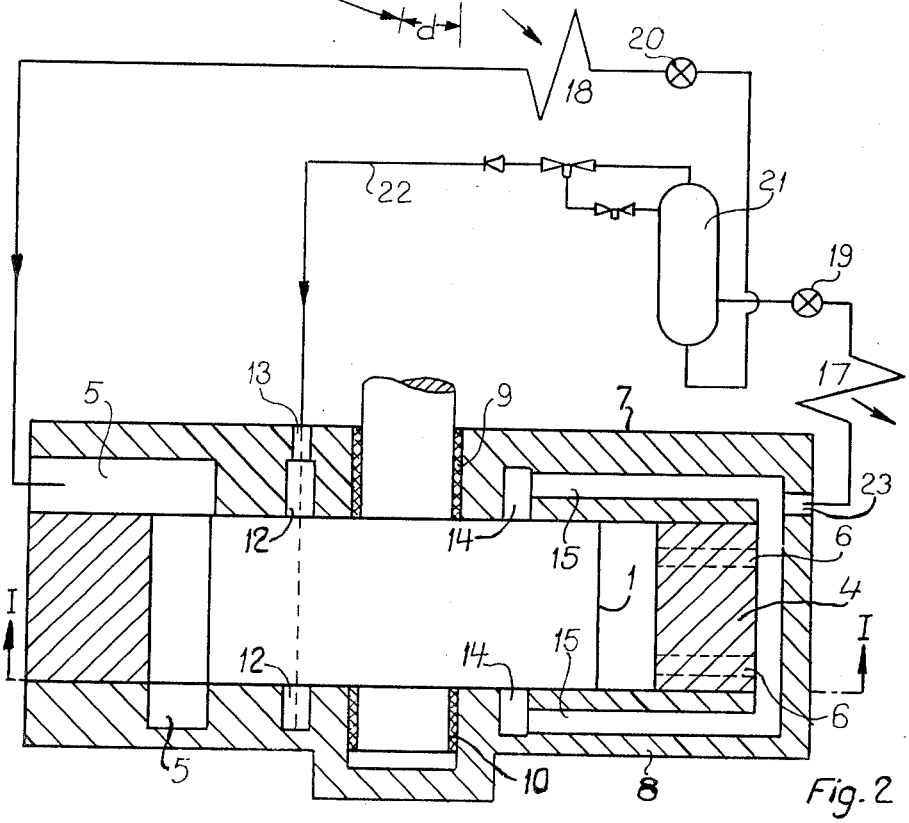
Figure 4:
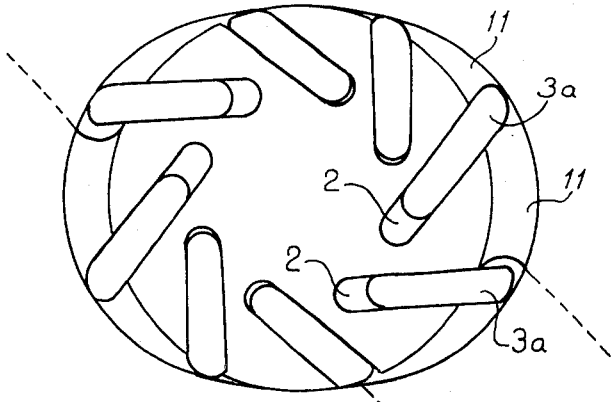
Figure 3:
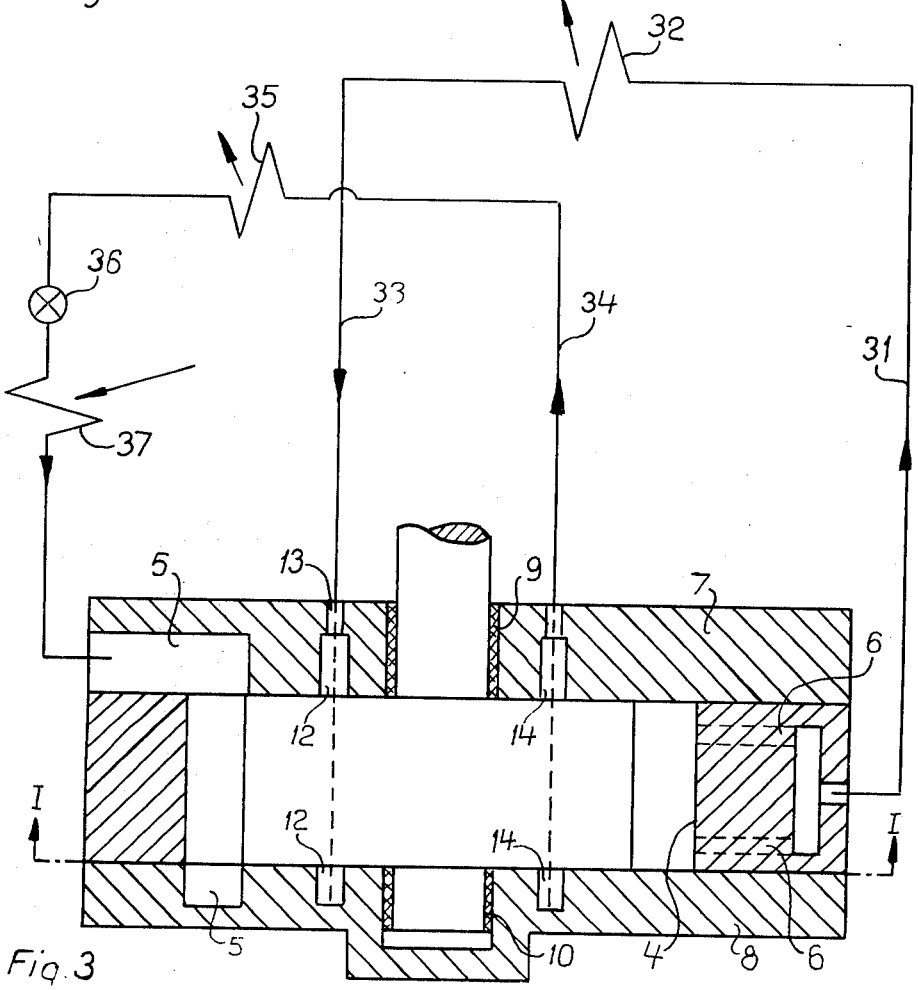

The various features of the invention will be more apparent on consideration of the attached drawing and the following detailed description, in which FIG. 1 is a plan view of a compressor of the double chamber type including the present invention and taken along the line I—I in FIGS. 2 and 3, FIG. 2 is a schematic view of a refrigeration system utilizing a compressor including the present invention containing in addition a sectional view of the compressor shown in FIG. 1, taken along the line II—II in FIG. 1, FIG. 3 is a schematic view of another refrigeration system utilizing a compressor including another embodiment of the present invention containing also a sectional view of the compressor shown in FIG. 1, and FIG. 4 is a plan view of a compressor including widened vane slots according to the present invention.

Referring now to the drawings, and particularly, FIGS. 1 and 2, the compressor comprises a rotor 1 of circular cross-section having vane slots 2 within which are slidably located vanes 3. Vanes 3 slide inwardly and outwardly in slots 2 as the rotor turns so that their outer ends continually bear against the inner circumferential wall of stator 4 which, as shown, has an elliptical cross-section. End plates 7, 8 of the stator contain bearings 9, 10 for the rotor shaft as well as inlet passages 5 and outlet passages 6. The sides of the vanes bear against the end plates 7, 8. The inlet and outlet passages can be provided with outlet valves formed as check valves, as is known in the art. Successive vanes 3 effectively divide the space between the stator and the rotor into working chambers 11, the volume of each of which increases as it passes over the inlet passages 5. As the rotor continues to turn, the working chamber volume gradually decreases, reaching a minimum as the chamber approaches exhaust passage 6. In this way suction, compression and discharge phases occur in each chamber as the rotor turns through about 180 degrees of arc. These phases are indicated in FIG. 1 by the angles *a*, *b* and *c* respectively.

It will be noted that the inward and outward movement of the vanes 3 in the sealed slots 2 as the rotor passes through the phases *a*, *b* and *c* suggests a pumping action. It is this action, normally wasted, that the present invention harnesses to accomplish useful work.

According to the present invention, grooves 12 and 14 are formed in end plates 7 and 8 opposite the path travelled by the inner ends of the vane slots 2 during the suction portion and the discharge portion, respectively, of their cycles. Grooves 12 communicate with a gas supply via inlet means comprising channels 13, and grooves 14 communicate with outlet means via channels 15, in the FIG. 2 embodiment, or conduit 34, in the FIG. 3 embodiment. It will now be seen that the angle *a* represents the suction phase of the space behind vanes 3 in slots 2 as well as the suction phase of each working chamber 11, because during the suction phase of each working chamber 11, the vanes 3 defining it are moving outward, enlarging the space left behind them in slots 2 and forming second working chambers. Similarly, and for complementary reasons, angle *b* represents the compression phase for the vane slots. During the discharge phase, represented by angle *c*, the vane slots are in communication with the grooves 14 in the end plates and thereby, via the channels 15 or conduit 34, with the outlet.

By this invention, a secondary compression unit is formed in the slots 2, and the capacity of the compressor will be increased by the total stroke volume of the sum of the vane slots, an amount that can reach about 10% or more.

By limiting the length of the grooves 14 or by locating them sufficiently far from the rotor axis so that they are overlapped by the vanes 3 near the end of the discharge phase of chambers 11, the vane slots 2 will be sealed from channels 13 at the end of the phase represented by angle *c*, that is, before the vanes have reached their innermost position in the vane slots. In this way a compression phase arises in the vane slots during the rotation of the rotor through angle *d*. This compression retards the inward movement of vanes 3, causing some loss of compressor output, but it simultaneously helps to eliminate vane jumping and ensures a firm engagement of the vanes against the inner circumferential wall of stator 4.

FIG. 2 shows one application of the invention, in which the compressor is connected to an expansion system having a circulating medium, as might be, for example, the case in a refrigeration plant. The discharge opening 23 of the compressor is connected to a condensor 17, from which the condensed refrigeration medium is led via a first expansion valve 19 to an intermediate pressure receptacle 21. From the bottom of this receptacle, liquid is led via the expansion valve 20 to the evaporator 18 and from there back to the inlet passage 5 of the compressor. The separated gas is led from the top of the receptacle 21 via the conduit 22 and channels 13 to the grooves 12 in the end plates of the compressor. From grooves 12 the gas is led into the vane slots 2 as each slot passes over groove 12 during the suction phase of the compressor cycle. The gas in each slot 2 is compressed as the vane retracts into the slot and is then discharged through the grooves 14 into channels 15 and on to the discharge opening 23.

While the principle of directing gas from an intermediate pressure receptacle in a refrigeration system back to an intermediate stage in the compressor is known, the present invention makes use of the pressure that the gas already has, pressure that would be wasted if the conduit 22 was connected to the inlet 5. By using the vane slots to compress the intermediate pressure gas, several advantages are obtained: the pumping action of the vanes is harnessed for useful work, and the pressure possessed by the gas in the vane grooves helps to press the vanes outwards even during the suction phase, promoting good engagement of the vanes with the stator wall and reducing vane jumping. In contrast to other systems, an improved cooling effect is obtained without increased effect on the axle of the compressor, since the vane slots must be pressurized in any case to obtain good sealing.

FIG. 3 shows how the invention can be used to compress a refrigeration medium in two stages. Refrigeration gas enters through inlet passage 5 of the compressor to working chambers 11, where it is compressed in a first stage to an intermediate pressure. This gas leaves the compressor through outlet passages 6 and is led by conduit 31 to an intermediate cooler 32. The intermediate pressure gas from the cooler is led by conduit 33, channels 13 and grooves 12 into the vane slots 2. As described in detail above, the gas is further compressed in slots 2, and this high pressure gas is fed, via the grooves 14 and conduit 34, to a condensor 35. From the condensor the gas passes through expansion valve 36 and is vaporized in an evaporator 37, from which the low pressure gas again is returned to the compressor through inlet passage 5. It will be appreciated that in this embodiment also the vanes are urged against the inner circumferential stator wall by the pressure of the gas in the vane slots simultaneously as the vane slots perform useful work.

FIG. 4 demonstrates how one may increase the working volume of the vane slots by widening the vane slots 2, and, correspondingly, vanes 3*a*. In this way the working volume of slots 2 can be adapted to the volume of the working chambers 11.

We claim:

1. A refrigeration circuit comprising a condensor having an inlet for compressed gas and an outlet, an intermediate pressure receptacle having an inlet and also having a gas outlet and a liquid outlet, a first expansion valve through which said condensor outlet is connected to said receptacle inlet, a second expansion valve connected to said liquid outlet of the receptacle, a low pressure duct leading from said second valve, an intermediate pressure duct leading from said gas outlet of the receptacle, and a compressor of the rotary vane type including a stator having a chamber of curved non-circular cross-section, defined by an inner surface and end plates, a rotor having a circular cross-section rotatably mounted within said chamber, the outer surface of said rotor, said end plates, and said inner surface defining a gas space, there being at least one inlet passage communicating with said gas space and to which said low pressure duct leads, there also being at least one outlet passage communicating with said gas space and connected to said condensor inlet, a plurality of vane slots in said rotor, a vane having inner and outer ends in each of said vane slots, said vanes being slidable inwardly and outwardly in said slots upon rotation of said rotor to permit the outer ends of said vanes to bear against the inner surface of said stator, successive vanes forming first working chambers of a first compression unit in said gas space and the outward movement of said vanes forming second working chambers in said slots, there being a plurality of grooves in at least one of said end plates, a first one of said grooves connecting with the second working chambers during at least one part of the outward movement of said vanes, and a second one of said grooves connecting with the second working chambers during at least one part of the inward movement of said vanes, gas inlet means connecting said intermediate pressure duct to said first groove, and gas outlet means connecting said second groove to said outlet passage from the gas space, whereby said second working chambers provide a secondary compression unit for compressing intermediate pressure gas from said receptacle.

* * * * *